United States Patent [19]

Stowe

[11] 4,089,925

[45] May 16, 1978

[54] METHOD FOR MAKING FACED BLOCKS

[76] Inventor: Gerald Leon Stowe, 4571 NE. Viewcrest La., Albany, Oreg. 97321

[21] Appl. No.: 568,888

[22] Filed: Aug. 6, 1975

[51] Int. Cl.[2] ..... B28B 1/16

[52] U.S. Cl. ..... 264/256; 264/333; 264/DIG. 57

[58] Field of Search ..... 264/DIG. 57, 71, 69, 264/256, 333; 249/131

[56] References Cited

U.S. PATENT DOCUMENTS 1,471,990 10/1923 Wert ..... 264/DIG. 57

*Primary Examiner*—Thomas P. Pavelko

[57] ABSTRACT

A method of making cementitious blocks wherein the blocks are provided with a facing of colored material. A mold is provided which leads itself to do-it-yourself application for the manufacture of faced blocks.

1 Claim, 4 Drawing Figures

METHOD FOR MAKING FACED BLOCKS

BACKGROUND OF THE INVENTION

This invention relates to the manufacture of faced blocks.

Figure 1:
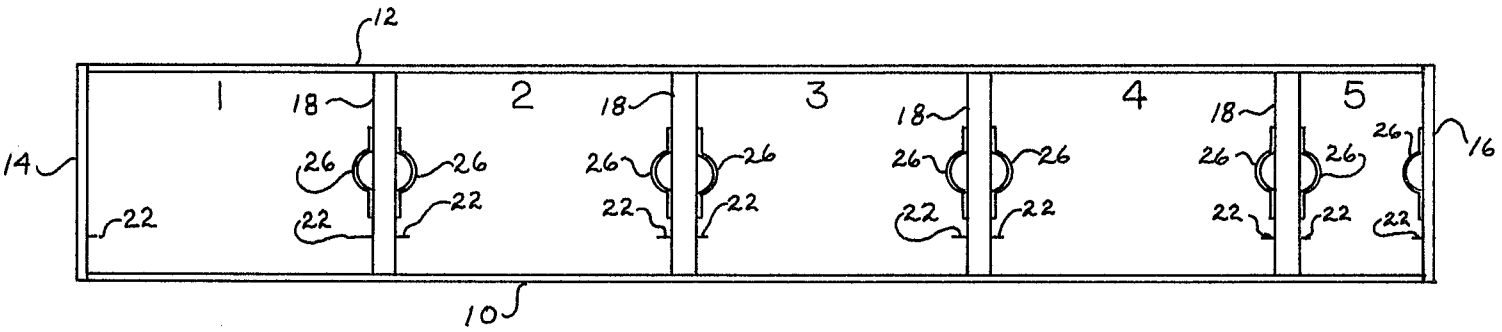
Figure 2:
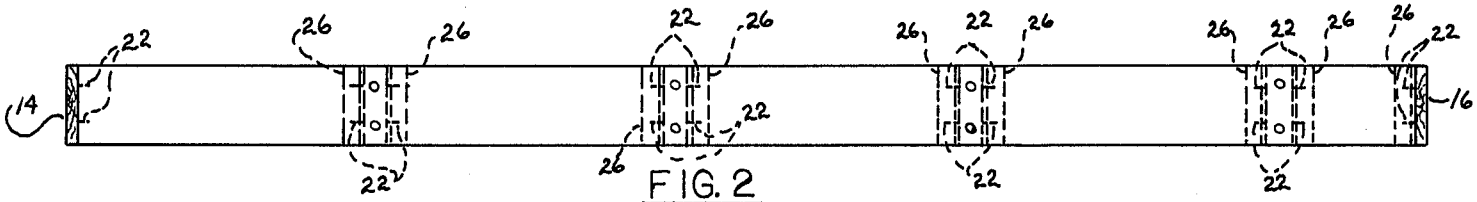

On sheet one you will find the sectional top view FIG. 1, and side view, FIG. 2 of the form used for the purpose of making the blocks, which can be gravel mix with cement, or a cement mix with pumice stone, or a adobe mixed mud with chopped straw or hay four inches in length.

After the adobe walls have been erected, builder can always use two twisted galvanized number 14 wires (not shown) laid between blocks in wall construction for the purpose of tie wires to tie on screen mesh for the plaster for the interior and mesh to hold stucco or cement for the exterior of adobe construction.

The forms drawn on sheet one are not drawn to scale, as it is possible to make forms any size that is desired either width or length, but heighth preferably 4 to 6 inches in width, and not under 12 to 16 inches in length. When these methods are followed builder can make good time in laying, as they lay much faster and do not require any more mort to lay than any other block used.

In FIG. 1 by number is the end block number one, numbers 2, 3, & 4, are the line blocks, and number 5 is the half block needed to fill in wall construction.

Figure 3:
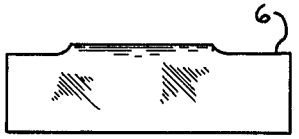
Figure 4:
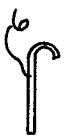

In FIG. 1 observe the nail brads 22 shown. These nails are inserted to hold the metal plate shown in front and side views in FIG. 3 and FIG. 4, respectively and which includes an integral curved handle. This plate is used for the purpose of making colored block facing, any color that builder desires or can obtain, which can be added to a cement mix, to be placed in front of the plate after the plate has been placed back of the brads, and the mix of concrete has been placed to hold the plate against the brad nail heads, for the placing of the colored mix for each block facing for exterior wall construction. After this has been done the plate can be lifted out by the curved top provided and some tamping of the two, mixes after plate has been removed to adhere facing mix to the other mix of main portion of the regular concrete in each block.

The half rounds of metal 26 as shown in FIG. 1 and FIG. 2 are in the center of each separator for the purpose of placing mort to keep each block when laid in alignment of the wall, which also can be left open. Concrete form nails are to be used in the assembledge of the sides of 1×4 to the 2×4 separators so the forms can be taken apart easily and used over again. This applies to 1×6 sides or separators if used. These blocks if laid on a good foundation of concrete, will still be here when about every thing else has dispersed, 2 or 3 generations at least.

If no metal in some cases are available, one can use tin cans by using tin snips by splitting one side open shaping the half round then using the other half to be flattened out on each side, to be nailed to each side of separator as shown in the top view sections of sheet one. By the extension of forms a builder can pour as many as 200 to 500 blocks a day, or as many as one thousand to twenty thousand a week.

I claim and desire to secure by Letters Patent:

1. A method of making blocks comprising (a) providing elongated, upright sidewalls (b) interconnecting said sidewalls with a plurality of separator plates (c) said separator plates being positioned to define a plurality of mold cavities (d) driving opposed brads partially into the separator plates at opposite ends of each mold cavity at a position spaced from each of said sidewalls so that said brads project into the mold cavity (e) placing insertion plates having a curved top portion in each mold cavity to rest against said brads to divide each mold cavity into a backing chamber and a facing chamber (f) placing a first uncured, block material mix in each of said backing chambers to hold said plates against said brads and placing a second, uncured facing material mix in each of said facing chambers (g) removing said insertion plates by lifting the curved top portions of said plates (h) tamping said first and second mixes to join and adhere said mixes to one another and, (i) curing the joined and adhered mixes to provide a block.

* * * * *

UNITED STATES PATENT OFFICE

CERTIFICATE OF CORRECTION

Patent No. 4,089,925 Dated 16 May 1978

Inventor(s) Gerald Leon Stowe

It is certified that error appears in the above-identified patent and that said Letters Patent are hereby corrected as shown below:

The TITLE OF INVENTION, page 1, line 2 should read:

-- METHOD OF MAKING CEMENTITIOUS BLOCKS PROVIDING FACING OF COLORED MATERIALS --

Signed and Sealed this

*Twelfth* Day of *August 1980*

[SEAL]

*Attest:*

SIDNEY A. DIAMOND

*Attesting Officer*

*Commissioner of Patents and Trademarks*